United States Patent [19]

Matz et al.

[11] Patent Number: 4,594,830

[45] Date of Patent: Jun. 17, 1986

[54] BONDING UNIT FOR REINFORCED CONCRETE STRUCTURAL COMPONENTS

[75] Inventors: Klaus Matz; Gerhard Ritter; Klaus Ritter, all of Graz, Austria

[73] Assignee: AVI Alpenl. Veredelungs-Industrie GmbH, A-Graz, Austria

[21] Appl. No.: 558,322

[22] Filed: Dec. 5, 1983

[30] Foreign Application Priority Data

Dec. 13, 1982 [AT] Austria ..... 4525/82

[51] Int. Cl.[4] ..... E04B 1/41

[52] U.S. Cl. ..... 52/334; 52/98; 52/378; 52/712; 404/68; 404/56

[58] Field of Search ..... 52/334, 378, 699, 700, 52/712, 701, 704, 707, 368, 376, 125.4, 98, DIG. 9; 404/50, 51, 64, 67, 68, 56

[56] References Cited

U.S. PATENT DOCUMENTS

| | | | |
|---|---|---|---|
| 519,553 | 5/1894 | Rounds | 52/98 |
| 1,420,220 | 6/1922 | Roux | 52/DIG. 9 |
| 2,489,851 | 11/1949 | Bean | 404/68 |
| 2,628,544 | 2/1953 | Miller | 404/67 |
| 2,771,110 | 11/1956 | Tuck | 52/98 |
| 3,347,515 | 10/1967 | White | 404/68 |
| 4,010,586 | 3/1977 | Brechbuhler | 52/378 |
| 4,400,918 | 8/1983 | Lewis | 52/98 |
| 4,419,852 | 12/1983 | Dietrich | 52/699 |
| 4,468,907 | 9/1984 | Tiletschke et al. | 52/378 |

FOREIGN PATENT DOCUMENTS

| | | | |
|---|---|---|---|
| 743754 | 4/1933 | France | 52/DIG. 9 |
| 2051917 | 1/1981 | United Kingdom | 52/699 |
| 2039581 | 8/1982 | United Kingdom | 52/699 |

OTHER PUBLICATIONS

Engineering Record, *Cypress Strips at Floor Block Joints,* 5/8/15, p. 585, TAI-E62.

*Primary Examiner*—John E. Murtagh
*Assistant Examiner*—Caroline Dennison
*Attorney, Agent, or Firm*—Marmorek, Guttmann & Rubenstein

[57] ABSTRACT

A unit for bonding two structural reinforced concrete components comprises a mounting strip having a pair of oppositely directed main faces and a plurality of connector rods held firmly on the mounting strip. Portions of the connector rods project at intervals along one side of the mounting strip and the connector rods have arms bent to a knee shape, the arms being positioned within the mounting strip. One of the main faces of the strip on the side away from the projecting portions of the connector rods defines at least two grooves parallel with one another and extending in the longitudinal direction of the mounting strip. The grooves have a width substantially equal to the diameter of the connector rods and a depth at least equal to the diameter. The mounting strip further includes holes at intervals along its length, the holes extending from the bottoms of respective ones of the grooves towards the opposite main face of the mounting strip. The connector rods are disposed individually through the holes, and the arms of the connector rods are arranged and held firmly within the grooves.

4 Claims, 9 Drawing Figures

BONDING UNIT FOR REINFORCED CONCRETE STRUCTURAL COMPONENTS

Figure 2A:
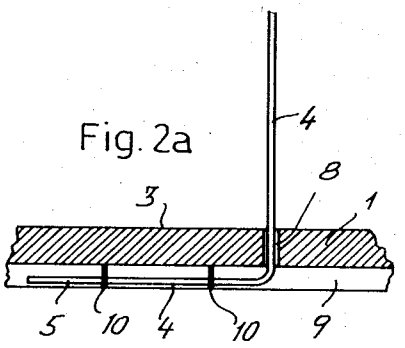

The invention relates to a unit for bonding together two structural reinforced concrete components, the unit consisting of a mounting strip which holds firmly a number of connector rods and from which portions of the connector rods project at intervals along one side, whilst arms of the connector rods bent to a knee shape are enclosed inside the mounting strip.

Bonding units of this type are known from the Austrian No. AT-A-342396. These known bonding units include a plurality of connector rods bent like a stirrup, which serve for bonding the two adjacent structural components which may be in the form e.g. of slabs, each stirrup being substantially U-shaped, the arms of the U being bent at right angles to the plane of the loop at a predetermined distance from its bridge and embedded in a mounting strip of hardened foam material.

In use, the strips of hardened foam material are nailed to the shuttering of the first of the two structural components, in such a way that the loops of the connector rods projecting out of the strips of foam material are surrounded by the concrete of the first structural part. After the concrete has set, the strips of foam material are broken away from the concrete of the first structural component and then the arms of the connector rods which were embedded in the strips are bent up in the direction perpendicular to the connecting face of the first structural component so that they form jumper reinforcement for the second of the structural components. The breaking out of the strips of foam material is just as troublesome and timewasting as the production of the connector rods themselves, which have to be bent in space, i.e., in two planes and which presupposes two separate working steps.

Other known bonding units use, as the mounting strip for the connector rods, a profiled strip having a cross-section the shape of a U and of metal, plastics or wood, which exhibits drilled holes through which the arms of stirruplike connector rods bent are pushed in such a way that these arms come to lie convergently with respect to one another and partially overlapping one another in the direction longitudinal to the strip within the cavity in the profiled strip. If necessary the profiled strip may be closed off by a coverplate (cf., e.g., No. DE-A-2944739). Instead of being formed of a single profiled strip each mounting strip may also be formed of two connected U-shaped profiled strips, one arm of each of the stirruplike connector rods then being received in the respective cavities in the two profiled strips (cf., e.g., No. CH-A-626676).

U-shaped profiled strips of metal or platics are expensive to use as mounting strips for the connector rods, especially since the mounting strips form lost components which remain in the concrete of the components. On the other hand employing wood as the material of the mounting strips means that a great quantity of material has to be machined away in order to create the cavity in the U-profile, and this constitutes a waste of material and leads to a considerable reduction in the moment of resistance of the wooden body, which has a very unfavourable influence upon its breaking strengh when it is not yet embedded in concrete, that is during handling and transport.

With bonding units just described the convergent arms of the stirrup-like connector rods, bent to a knee, do indeed make it possible to arrange the stirrups at short pitches because the arms from the knee of adjacent stirrups can partially overlap in the direction longitudinal to the mounting strip like the bones of a fish, but they demand elaborate bending operations and elastic deformation of the stirrups during introduction of the arms into the holes drilled in the strips. Further, with mounting strips which receive the arms of the connector rods in common cavities the positions of the connector rods are not exactly defined unless additional holders are provided for the parts of the rods passing through the drilled holes. Furthermore what is common to all known kinds of bonding units is poor adaptability to different lengths of the faces of the two components.

An object of the invention is to simplify bonding units of the species specified initially as regards their overall construction and in doing so to create the possibility of eliminating the defects of the known bonding units described above.

In accordance with the invention, a unit for bonding two structural components of reinforced concrete and consisting of a mounting strip which holds a number of connector rods and from which portions of the connector rods project at intervals along one side, arms of the connector rods bent to a knee shape being enclosed inside the mounting strip, is characterized in that two or more parallel grooves running substantially longitudinally of the mounting strip are provided, on the main face of the mounting strip away from from projecting portions of the connector rods, the width of the grooves being substantially equal to the diameter of the connector rods and the depth of the grooves being at least equal to this diameter, holes running from the bottom of the groves towards the opposite main face of the mounting strip being provided at intervals along the mounting strip through each of which hole passes one of the connector rods, the arms of the connector rods lying in the respective groove.

In this way simple basic shapes result both for the connector rods and also for the mounting strips, so that these parts can also be easily combined, especially since stirrups having convergent arms are not necessary. The moment of resistance of the cross-section of the mounting strip is only slightly diminished by the grooves, but the arms of the rods bent to a knee may easily be held fast in the parallel grooves. Further, after embedding the parts of the connector rods projecting out of the mounting strip in a first reinforced concrete component, the arms of the connector rods previously bent at a knee can be bent unimpeded out of the grooves on the outside of the mounting strip and - if necessary after withdrawal of the mounting strip - embodiment in the second reinforced component.

Figure 2B:
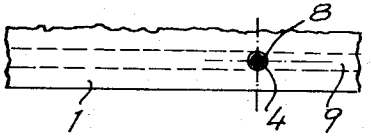
Figure 1:
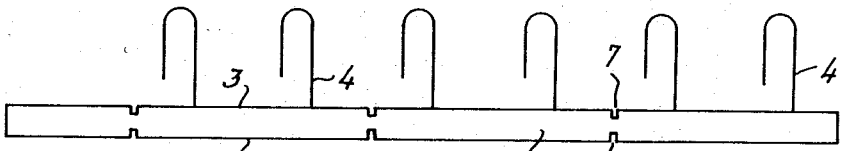
Figure 3A:
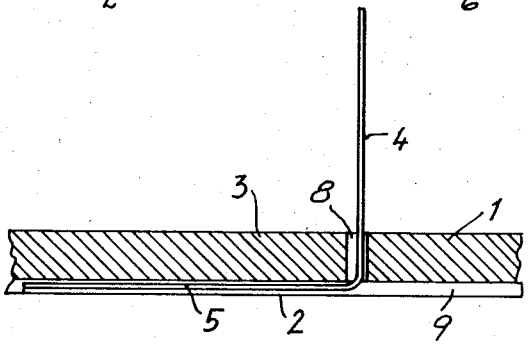
Figure 3B:
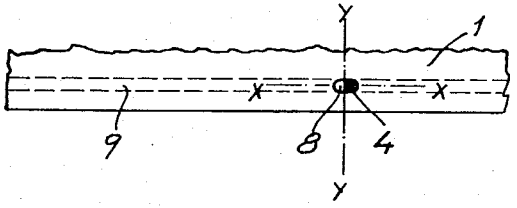

Embodiments of units according to the invention will now be described with reference to the accompanying drawings in which:

FIG. 1 is a side elevation of a first bonding unit;

FIG. 2*a* is a longitudinal section through a portion of a bonding unit;

FIG. 2*b* is a plan view of the FIG. 2*a* unit;

FIG. 3*a* is a longitudinal section through a portion of another bonding unit;

FIG. 3*b* is a plan with respect to FIG. 3*a;*

Figure 4:
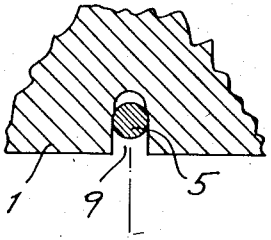
Figure 5A:
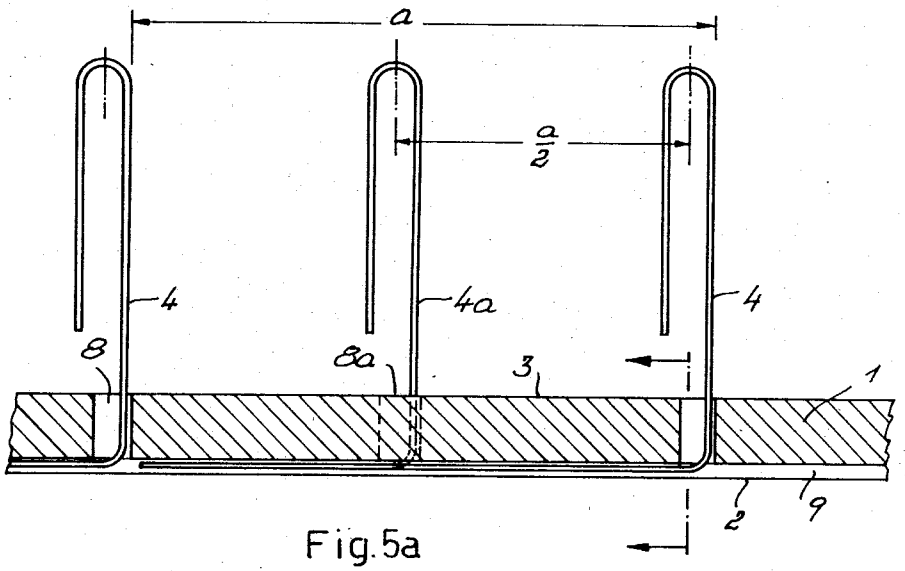
Figure 5B:
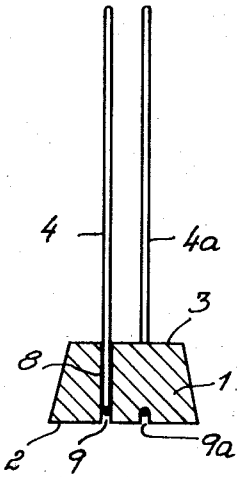
Figure 6:
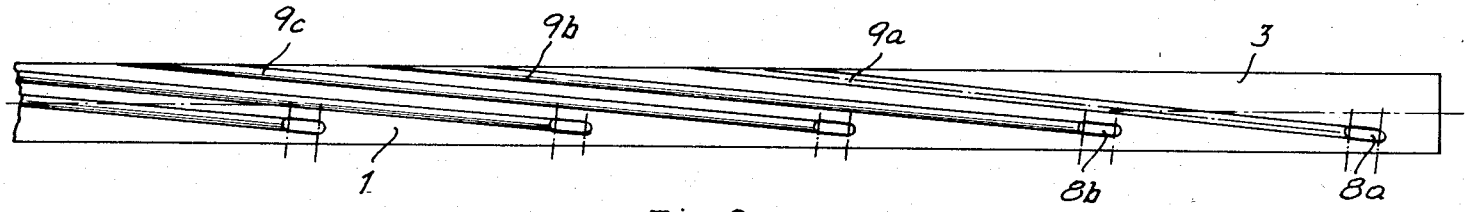

FIG. 4 is a cross-section with respect to FIG. 2*a* or FIG. 3*a*, showing on a larger scale a groove and the arm of the connector rod embedded in it;

FIGS. 5*a* and 5*b* are a longitudinal section and an associated cross-section respectively through another embodiment of the invention;

FIG. 6 is a plan of the grooved main face of a further embodiment.

In FIG. 1 there may be seen a mounting strip 1 having main faces 2 and 3 lying opposite one another, out of which project the end portions of connector rods 4 bent, for example, into the shape of a hook. By means of parting lines 6, 7 arranged preferably at equal intervals from one another, predetermined points of break are formed in the mounting strip in order to enable the mounting strip to be adapted easily to different lengths of the joint at the bond between two structural components. In order to facilitate separation into sections, the parting lines are preferably incorporated into both the faces 2, 3 of the mounting strip, though the outer parting line 6 in particular should preferably be made as narrow as possible in order, as far as possible, to prevent the penetration of concrete on site. Mounting strips of wood, cane or pressboard may be nicked by means of a saw at the predetermined points of break; in the case of mounting strips of concrete oiled metal strips may be laid in the shuttering at the predetermined points of break.

FIG. 2*a* shows a section through a portion of a first bonding unit which as a variant carries connector rods 4 bent merely at a right angle. Each connector rod 4 passes through a regularly cylindrical drilled hole 8 which may be seen in FIG. 2*b*, the diameter of which is only sufficiently greater in diameter than the connector rod 4 so that the connector rod can be pushed through the drilled hole without resistance. Reliable guidance of the connector rod 4 in the drilled hole is thereby guaranteed.

One arm of each connector rod 4 bent to a knee rests in the groove 9 open to the lower main face 2 of the mounting strip 1, its depth in this case being a little greater than the diameter of the rod plus the radius of bend of the connector rod at the knee. The arm 5 of the connector rod 4 is held fast in this groove 9 by e.g., clips 10. With this choice of the depth of the groove the knee of the connector rod 4 lies in the groove 9.

A very similar embodiment is shown in FIGS. 3*a* and 3*b*. In this case, however, the depth of the groove 9 is only slightly greater than the rod diameter. The drilled hole 8 is instead made as an oblong hole, the plane of symmetry x—x of which coincides with the longitudinal central plane of the groove 9 running in the direction longitudinal to the mounting strip and moreover lies perpendicular to the parallel main faces 2, 3 of the mounting strip 1. The width of the oblong hole 8 is again about equal to the rod diameter, whereas the length of the oblong holes is about equal to the radius of bend of the connector rod at the knee plus the rod diameter. Thus the knee of the connector rod can lie in the drilled hole 8.

As shown in FIG. 4, the anchoring of the arm 5 of the connector rod 4, resting in the groove 9, onto the mounting strip 1 may also be effected by the groove 9 being made a little narrower than the diameter of the connector rod and the arm 5 of this rod bent to a knee being pressed into the groove 9 and then held fast in it by being a jam fit.

FIGS. 5*a* and 5*b* show a bonding unit having two grooves 9 and 9*a* parallel with the longitudinal centreline of the mounting strip, in which are arranged connector rods 4 and 4*a*. Along each groove a number of drilled holes 8 are provided, arranged at intervals a which connect the bottom of the groove to the ungrooved main face 3 of the mounting strip 1. The drilled holes 8 are in this case made as oblong holes, the length of which is so dimensioned that the straight parts of the ready-bent connector rods may be passed through a drilled hole 8 and subsequently by turning the rod through 90° in the longitudinal central plane of the drilled hole may be brought into a position parallel with the groove 9 and be pressed into it. The connector rods 4 and 4*a* respectively associated with each individual groove 9 and 9*a* respectively and the drilled holes 8 and 8*a* respectively which receive them have a distance apart a, but the drilled holes in the adjacent grooves are offset with respect to one another by the distance a divided by the number of grooves—that is, in the case of two parallel grooves they are offset from one another by ½. In this way, for a given length of the arms 5 of the connector rods 4 resting in the grooves 9 and 9*a* respectively, the number of connector rods per unit length may be increased and hence also the force which can be transmitted along the butt joint between the two structural parts which are to be bonded.

Finally it may also be seen from FIG. 5*b* that the mounting strip 1 advantageously has a trapezoidal cross-section, the grooved main face 2 of the mounting strip 1 being wider than the ungrooved main face 3. Through this construction the mounting strip, after bending up the arms 5 of the connector rods 4 lying in the grooves, into a position perpendicular to the groove main face 2, can easily be loosened out of the surrounding concrete of the first or the two structural parts of reinforced concrete which are to be bonded, so that between the two structural parts there arises a kind of tongue-and-groove joint. In order further to facilitate the loosening of the mounting strip 1 when desired, the mounting strip may be saturated for example, also with form oil.

A further possible embodiment of a bonding unit in accordance with the invention is shown in FIG. 6. In the case of this embodiment the mounting strip 1 contains a plurality of grooves 9*a* , 9*b* . . . running parallel with one another at an acute angle to the longitudinal central plane of the mounting strip, with each of which there is associated only one drilled hole 8*a*, 8*b* . . . If these drilled holes are made as shown as oblong holes, the longitudinal central plane of the oblong hole must again coincide with the longitudinal central plane of the associated groove. This embodiment of the invention represents another possiblity of providing a larger number of connector rods per unit length of the mounting strip than is possible if all connector rods are arranged one behind the other in a single groove.

We claim:

1. A unit for bonding two structural reinforced concrete components, said unit comprising a mounting strip having a pair of oppositely directed main faces and a plurality of connector rods held firmly on said mounting strip, portions of said connector rods projecting at intervals along one main face of said mounting strip and said connector rods having arms bent to a knee shape, said arms being positioned within said mounting strip, wherein one of said main faces of said strip on the side away from the projecting portions of said connector rods defines at least two grooves parallel with one another and extending in the longitudinal direction of said mounting strip, said grooves having a depth at least equal to said diameter, said mounting strip further including holes at intervals along its length, said holes extending from the bottoms of respective ones of said grooves toward said opposite main face of said mounting strip, the connector rods being disposed individually through said holes, said arms of said connector rods being arranged and held firmly within said grooves, said bonding unit further including a plurality of clips, said clips holding said arms of said connector rods in said grooves.

2. A unit for bonding two structural reinforced concrete components, said unit comprising a mounting strip having a pair of oppositely directed main faces and a plurality of connector rods held firmly on said mounting strip, portions of said connector rods projecting at intervals along one main face of said mounting strip and said connector rods having arms bent to a knee shape, said arms being positioned within said mounting strip, wherein one of said main faces of said strip on the side away from the projecting portions of said connector rods defines at least two grooves parallel with one another and extending in the longitudinal direction of said mounting strip, said grooves having a depth at least equal to said diameter, said mounting strip further including holes at intervals along its length, said holes extending from the bottoms of respective ones of said grooves toward said opposite main face of said mounting strip, the connector rods being disposed individually through said holes, said arms of said connector rods being arranged and held firmly within said grooves, wherein the width of said grooves is slightly less than said diameter of said connector rods, whereby said arms of said connector rods are held fast in said grooves by being a jam fit therein.

3. A unit for bonding two structural reinforced concrete components, said unit comprising a mounting strip having a pair of oppositely directed main faces and a plurality of connector rods held firmly on said mounting strip, portions of said connector rods projecting at intervals along one side of said mounting strip and said connector rods having arms bent to a knee shape, said arms being positioned within said mounting strip, wherein one of said main faces of said strip on the side away from said projecting portions of said connector rods defines at least two grooves parallel with one another and extending in longitudinal direction of said mounting strip, said grooves being parallel with the longitudinal central plane of said mounting strip, said grooves having a width substantially equal to the diameter of said connector rods and a depth at least equal to said diameter, said mounting strip further including a plurality of holes arranged at equal intervals a along each of said grooves, said holes in each said groove being offset with respect to said holes in the other of said grooves by said interval a divided by the number of said grooves, said holes extending from the bottoms of respective ones of said grooves towards said opposite main face of said mounting strip, said connector rods being disposed individually through said holes, and said arms of said connector rods being arranged coaxially and held firmly within said grooves.

4. A unit for bonding two structural reinforced concrete components, said unit comprising a mounting strip having a pair of oppositely directed main faces and a plurality of connector rods held firmly on said mounting strip, portions of said connector rods projecting at intervals along one side of said mounting strip and said connector rods having arms bent to a knee shape, said arms being positioned within said mounting strip, wherein one of said main faces of said strip on the side away from said projecting portions of said connector rods defines at least two grooves parallel with one another and extending in the longitudinal direction of said mounting strip, said grooves having a width substantially equal to the diameter of said connector rods and a depth at least equal to said diameter, said mounting strip further including holes at intervals along its length, said holes extending from the bottoms of respective ones of said grooves towards said opposite main face of said mounting strip, said connector rods being disposed individually through said holes, said arms of said connector rods being arranged coaxially and held firmly within said grooves, said holes being oblong holes having a longitudinal central plane, said longitudinal central plane coinciding with the longitudinal central plane of the associated one of said grooves and said holes being disposed perpendicular to said main faces of said mounting strip, the width of said holes being about equal to the diameter of said connector rods and the length of said oblong holes being at least equal to the radius of bend of said connector rods plus the diameter of said connector rods.

* * * * *